United States Patent [19]

Marcel et al.

[11] Patent Number: 4,624,339

[45] Date of Patent: Nov. 25, 1986

[54] SOUND-PROOFING CASING FOR A PNEUMATIC PERCUSSIVE DRILL

[75] Inventors: Frédéric E. Marcel, Verneuil-En-Halatte; Francois J. M. Maume, Pont-Ste-Maxence, both of France

[73] Assignee: Charbonnages de France, Paris, France

[21] Appl. No.: 667,735

[22] Filed: Nov. 2, 1984

[30] Foreign Application Priority Data

Nov. 10, 1983 [FR] France ..... 83 17900

[51] Int. Cl.[4] ..... F01N 1/08

[52] U.S. Cl. ..... 181/230; 173/DIG. 2

[58] Field of Search ..... 173/90, DIG. 2

[56] References Cited

U.S. PATENT DOCUMENTS

| | | | |
|---|---|---|---|
| 2,789,653 | 4/1957 | Fannen | 181/230 |
| 3,255,844 | 6/1966 | Wallace | 173/DIG. 2 |
| 3,481,411 | 12/1969 | Wood . | |
| 3,757,875 | 9/1973 | Gunning | 173/DIG. 2 |
| 4,113,049 | 9/1978 | Lieber | 173/DIG. 2 |
| 4,294,330 | 10/1981 | Baldwin et al. | 181/230 |
| 4,327,807 | 5/1982 | Emonet | 173/DIG. 2 |
| 4,346,783 | 8/1982 | Scarton et al. | 181/230 |
| 4,407,390 | 10/1983 | LeBlanc, Jr. | 181/230 |

FOREIGN PATENT DOCUMENTS

| | | | |
|---|---|---|---|
| 755872 | 4/1967 | Canada | 173/DIG. 2 |
| 2913330 | 10/1980 | Fed. Rep. of Germany . | |
| 1401587 | 4/1965 | France . | |
| 1416101 | 9/1965 | France . | |
| 2240652 | 3/1975 | France . | |
| 2420043 | 10/1979 | France . | |

OTHER PUBLICATIONS

Baumaschine und Bautechnik, vol. 12, No. 9, Sep. 1965, (Wiesbaden, DE) G. Garbotz, "Larmabwehr im Baubetrieb und bei Baumaschinen", pp. 421–423, p. 422, No. 7, p. 423, FIGS. 4, 5.

*Primary Examiner*—E. R. Kazenske
*Assistant Examiner*—Willmon Fridie, Jr.
*Attorney, Agent, or Firm*—Cushman, Darby & Cushman

[57] ABSTRACT

The internal absorbent layer (9) of the casing delimits an internal volume (10) around the drill (1), which volume is divided on either side of the exhaust orifice (3) by two transverse partitions (13A, 13B) into three successive expansion chambers (11A, 11B, 11C) between the exhaust orifice (3) and the outlet opening (12) to the air outside the casing.

8 Claims, 4 Drawing Figures

SOUND-PROOFING CASING FOR A PNEUMATIC PERCUSSIVE DRILL

The invention relates to a sound-proofing casing for enclosing a pneumatic percussive drill in order to attenuate the noise made thereby, and principally the noise made at its exhaust by the expansion of air leaving the drill.

The casing of the invention is particularly useful for sound-proofing pneumatic drills of the rotary-percussive type installed on drilling jumbos in mines and in quarries.

BACKGROUND OF THE INVENTION

Personnel in the vicinity of these machines are exposed to high noise levels, exceeding 105 dB(A), which cause physiological disorders and in particular deafness.

It is known that the main sources of noise are the air exhaust, the drill bit and the drill body. The total sound energy emitted by the drill mechanism (ie. by the drill body and by the air exhaust) varies from 35% to 90% of the total overall radiated energy, depending on whether the drill is a heavy drill or a light drill and on whether the drill bit is of small or large cross section. It is thus particularly important to reduce the noise emitted by the drill mechanism.

Proposals have already been made, in particular in an article entitled "Noise Control of Jumbo-Mounted Percussive Drills" which appeared in the journal "NOISE CONTROL ENGINEERING", volume 15, No. 3, November–December 1980, to enclose the drill mechanism in a casing of heavy gauge sheet metal ($\frac{1}{4}$" to $\frac{3}{8}$"thick) which is easy to open and which has its inside surface covered in acoustically insulating material (in particular glass wool) which is held in place by a perforated plate. According to this document, neither the casing, nor the insulating material, nor the perforated retaining plate are in contact with the drill mechanism. It is essential to avoid contact as much as possible between the casing and the drill. The drill touches the casing only via its base plate. There is thus an empty interior volume between the drill and the casing, over the entire length thereof. The front wall of the casing has an opening to allow the air coming from the drill mechanism exhaust orifice to be evacuated to the atmosphere. Air flows freely between the orifice and the opening through which it escapes to free air.

Preferred embodiments of the present invention provide a sound-proofing casing for a pneumatic drill, which casing is designed to improve effectiveness from the point of view of reducing the noise due to the air exhaust.

SUMMARY OF THE INVENTION

The present invention provides a casing for a pneumatic drill having an air exhaust orifice, the casing comprising portions which are easily opened and which include an outlet opening in one wall to allow the exhaust air to escape to the atmosphere, said air outlet opening being distant from the exhaust orifice, the inside of the casing further comprising acoustically absorbent material which, in the assembly, delimits an internal volume around the drill; according to the invention the casing co-operates with internal partitions situated on the path running from the exhaust orifice to the air outlet opening over a substantial fraction of the internal volume to divide said volume into at least two chambers which are interconnected by a communication passage of small cross section.

Preferably, the internal volume is divided lengthwise into three successive chambers between the exhaust orifice and the outlet opening.

In this manner, the casing performs the function of a pipe with successive stages of air expansion, in the manner of an exhaust pipe, in addition to its role as a sound-proofing casing.

In a preferred embodiment of the invention, a first expansion chamber is created on the exhaust orifice side of the drill by means of two partitions running across the drill body, said partitions being disposed on either side lengthwise of the exhaust orifice; one of the partitions being perforated by a plurality of exhaust holes. In this manner, the air penetrates into a second expansion chamber and then takes a communication passage of narrow cross section running over the opposite side of the drill to its exhaust orifice side to reach a third expansion chamber from which the air outlet opening opens out.

It is also preferable for the partitions to be in direct contact with the drill body and for them to make contact with the casing via the absorbent material that is a part thereof.

The absorbent material is advantageously a polyurethane foam whose surface is burnt so that its surface pores are closed to present a continous closed surface. In addition the metal part of the casing is a composite sheet which is commercially available and which comprises a first, outer sheet of steel, a layer of damping material, and a second, inner sheet of steel.

BRIEF DESCRIPTION OF THE DRAWINGS

A preferred embodiment of the invention is described by way of non-limiting example, with reference to the accompanying drawing, in which.

MORE DETAILED DESCRIPTION

Figure 1:
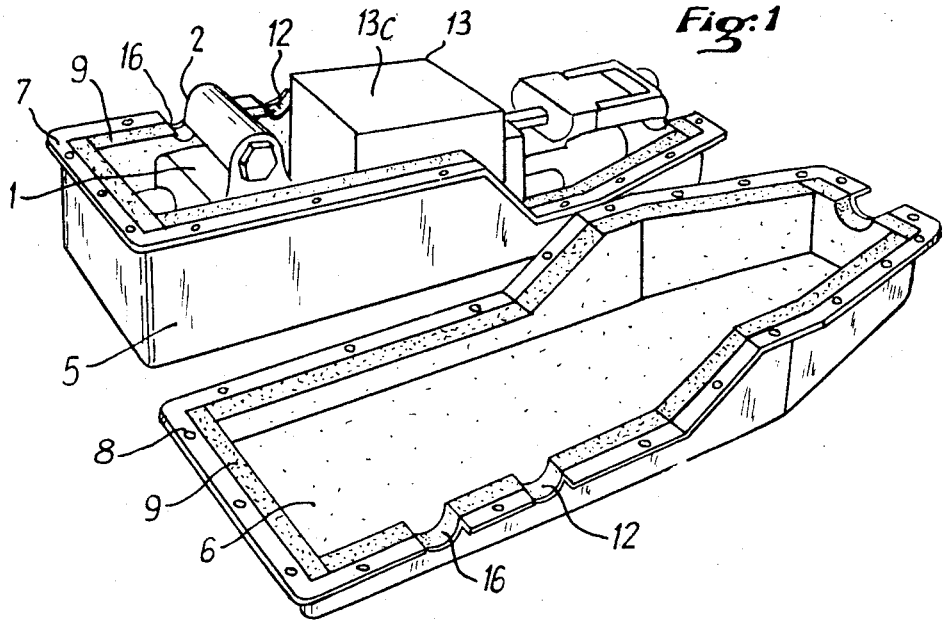
FIG. 1 is a perspective view of the rear of a casing in accordance with the invention, drawn in the open state to show the drill contained in the casing.
Figure 2:
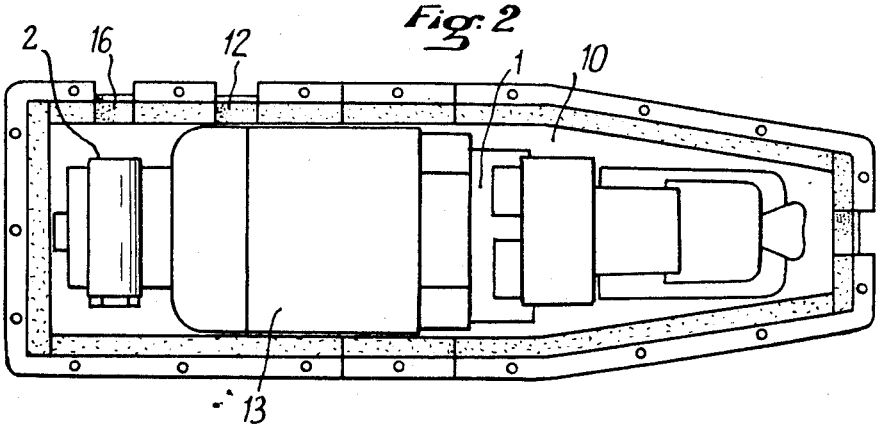
FIG. 2 is a view from above of the portion of the casing containing the drill in FIG. 1.

A pnuematic drill 1 has a compressed air feed orifice 2 and an exhaust orifice 3 for used air. The relative positions of the orifices 2 and 3 on the drill may vary between manufacturers. The invention is readily adaptable to these orifices being in any position.

A casing in accordance with the invention comprises three parts: a base plate 4 for fixing to a drill carriage (jumbo) on which the drill is fixed during use. The drill 1 is fixed to the base plate 4 by means of its own base plate 1A. A casing body 5 contains nearly the entire drill 1. A cover 6 is fixable to the body 5 of the casing.

The cover 6 and the body 5 are interconnected in a joint plane by means of matching peripheral flanges 7 and 8 which have bolt-receiving holes formed therein. The joint plane is stepped such that it drops to nearer to the base plate 4 at the front end of the drill 1 so as to make the front end, which is where the drill bit (not shown) is installed, more accessible after the cover 6 has been removed.

The base plate 4, the body 5 and the cover 6 are all made of composite sheet which is completely covered on its inside face, after the casing has been made, with acoustically absorbent material 9. Any suitable absorbent material may be used. In this example, the interior absorbent material 9 is commercially available polyurethane foam, fairly firm, having open pores, and whose exposed surface is burned to become continuous, relatively smooth, and proof against ingress by grease.

The composite metal sheet comprises and outer or first steel sheet which is 3.5 mm thick, a 0.5 mm thick layer of damping material, and an inner steel sheet which is 1 mm thick. The total thickness of the wall of the casing 1 is 30 mm, comprising 5 mm of composite sheet and 25 mm of internal absorbent material 9. Such a casing is effective because of its heterogeneous constitution. However, the composite sheet could be replaced with a heterogeneous synthetic material made in some other way, for example by casting a fiber reinforced synthetic material.

Figure 3:
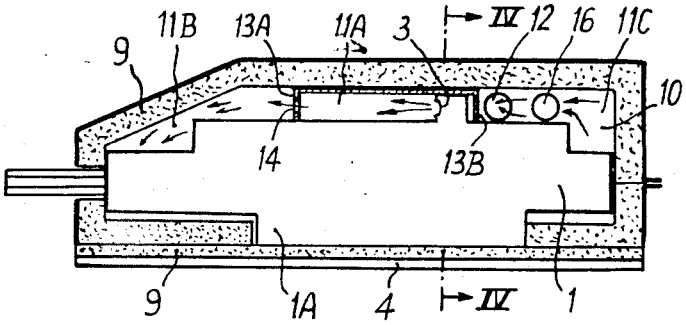
FIG. 3 is a diagrammatic elevation and longitudinal section through a casing in accordance with the invention drawn in the closed position to show the successive expansion chambers.
Figure 4:
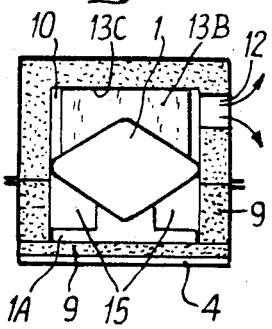
FIG. 4 is a diagrammatic cross section view on line IV—IV of FIG. 3.

Except for the place where the drill base plate 1A rests on the casing base plate 4, or more precisely on the layer of insulating material 9 which forms a part of the base plate 4, and also except for its side and end faces, the casing delimits an internal volume 10 around the drill 1. This internal volume is divided into a plurality of successive intercommunicating expansion chambers. In this example, there is a first chamber 11A into which the drill exhaust orifice 3 open out, a second or intermediate chamber 11B, and a third chamber 11C from which there opens an opening 12 passing through the side wall of the casing to provide the exhaust air with an outlet to the atmosphere. Preferably, the outlet opening 12 lies across the joint plane between the cover 6 and the body 5 (which is not as shown in FIGS. 3 and 4). In contrast, these two figures show the three chambers 11A, 11B and 11C better. The chambers are constituted by two partitions 13A and 13B which lie across the drill 1 and which divide the internal volume 10 lengthwise (relative to the drill) into the three chambers running from the exhaust orifice 3 to the outlet opening 12. Thus the first chamber 11A lies in the drill's middle portion (lengthwise) and it contains the exhaust orifice 3.

The partition 13A is pierced by a plurality of holes 14 which put the first chamber 11A into communication with the second chamber 11B.

The partitions 13A and 13B are on the top of the drill 1 as is the exhaust orifice 3. They completely or nearly completely divide the internal volume 10 in the transverse direction, but there remain two symmetrical passages 15 on the other or under side of the drill 1, between the drill body and the drill base plate. These passages 15 are of relatively small cross section, which could be reduced if need be, and they serve to put the second chamber 11B into communication with the third chamber 11C.

Thus, on leaving the drill's exhaust orifice 3, the exhaust air expands successively in the three chambers 11A, 11B and 11C, before reaching the outlet orifice 12.

The partitions 13A and 13B may be made in numerous equivalent ways. They may be integrally formed with the casing, eg. with its cover 6, and thus come into contact with the drill. They could equally well be fixed to the surface of the drill so that the inside surface of the casing presses against their edges, or more particularly so that the inside surface of the insulating material 9 presses thereagainst. In the example describe here, another variant has been shown. The partitions 13A and 13B are the two longitudinal end walls of a box 13 which is best seen in FIG. 1. The box is placed upside-down on the upper face of the drill, to which it is fixed, so as to contain the exhaust orifice 3. The box 13 has a flat bottom 13C which presses against the inside face of the insulating material 9 that forms a part of the cover 6. Opposite to the drill's compressed air feed orifice 2, the casing has an opening 16 to pass the feed pipe. This opening 16 likewise preferably lies across the joint plane between the body 5 and the cover 6.

The partitons 13A and 13B are shaped and disposed as a function of the relative positions of the feed orifice 2 and the exhaust orifice 3 so as to provide the wanted expansion chambers between the exhaust orifice 3 and the outlet opening 12.

We claim:

1. A casing for pneumatic drill of the type having an air exhaust orifice, said casing containing substantially the entire pneumatic drill and comprising at least two portions with each portion being removably attachable to the other portion, each portion having an internal surface provided with absorbent material, said absorbent material of one of said portions supporting the drill, said casing entirely surrounding and enclosing the drill and having a wall being provided with an outlet opening for exhaust air which, with a pneumatic drill placed in said casing, the exhaust orifice of the drill will be remote from said opening, said casing defining together with a drill disposed therein, an internal volume, said internal volume being divided between the exhaust orifice of the drill and said opening by transverse partition means into at least two successive chambers having passage means communicating therebetween, said chambers being disposed adjacent to one another along the length of the drill.

2. The casing as claimed in claim 1 wherein said two portions comprise an upper portion and a lower portion with said lower portion providing support for said drill; said pneumatic drill including a tool and said casing having an opening through which said tool extends exteriorally of said casing.

3. A casing according to claim 1, wherein the internal volume is divided into three successive intercommunicating chambers between the exhaust orifice and the outlet opening.

4. A casing according to claim 3, wherein the transverse partitions means are situated on the side of the drill including the exhaust orifice, with communication between two of the successive chambers taking place via at least one passage on the other side of the drill.

5. A casing according to claim 4, wherein the transverse partition means are disposed on either side of the exhaust orifice in the middle zone of the drill such that the first chamber is located in the said middle zone and contains the exhaust orifice.

6. A casing according to claim 5, wherein the transverse partition means closest to the front of the drill is pierced by a plurality of holes which provide communication with the next chamber.

7. A casing according to claim 6, wherein the internal volume is divided on the exhaust orifice side of the drill into three chambers by means of a box placed upside-down on the top face of the drill to contain said exhaust orifice, said box having a flat bottom which is pressed against the inside face of the casing's internal insulating material.

8. A casing according to claim 1, constituted by a composite sheet comprising a first sheet of steel, a damping layer, a second sheet of steel, and an inside layer of acoustically absorbent material.

* * * * *